US009335122B2

(12) United States Patent
Choiniere

(10) Patent No.: US 9,335,122 B2
(45) Date of Patent: May 10, 2016

(54) SYSTEM AND METHOD OF ALIGNING AN ACCESSORY AIMPOINT TO AN AIMPOINT OF A DEVICE

(71) Applicant: BAE SYSTEMS INFORMATION AND ELECTRONIC SYSTEMS INTEGRATION INC., Nashua, NH (US)

(72) Inventor: Michael J. Choiniere, Merrimack, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 14/509,090

(22) Filed: Oct. 8, 2014

(65) Prior Publication Data

US 2015/0143732 A1 May 28, 2015

Related U.S. Application Data

(60) Provisional application No. 61/909,787, filed on Nov. 27, 2013.

(51) Int. Cl.
*F41G 3/06* (2006.01)
*F41G 1/54* (2006.01)
*F41G 3/32* (2006.01)

(52) U.S. Cl.
CPC .. *F41G 1/54* (2013.01); *F41G 3/06* (2013.01); *F41G 3/326* (2013.01)

(58) Field of Classification Search
CPC ..... F41G 3/00; F41G 3/02; F41G 3/06; F41G 3/065; F41G 3/14; F41G 3/145; F41G 3/26; F41G 3/2622; F41G 3/2616; F41G 3/2644; F41G 3/2655; F41G 3/2683; F41G 3/2688; F41G 3/32; F41G 3/323; F41G 3/326
USPC ..... 42/134, 113, 120, 122
See application file for complete search history.

(56) References Cited

U.S. PATENT DOCUMENTS

| | | | | |
|---|---|---|---|---|
| 4,774,402 | A * | 9/1988 | Boeck et al. | 356/138 |
| 6,061,918 | A * | 5/2000 | Schnell | 42/121 |
| 6,247,259 | B1 * | 6/2001 | Tsadka et al. | 42/114 |
| 6,373,628 | B1 * | 4/2002 | Gunnarsson | F41G 1/30 359/399 |
| 6,742,299 | B2 * | 6/2004 | Strand | 42/134 |
| 8,201,741 | B2 * | 6/2012 | Bennetts et al. | 235/454 |
| 8,316,551 | B2 * | 11/2012 | Gorsuch et al. | 33/265 |
| 8,336,776 | B2 * | 12/2012 | Horvath et al. | 235/407 |
| 8,408,460 | B2 * | 4/2013 | Schneider et al. | 235/412 |
| 8,826,583 | B2 * | 9/2014 | Kepler et al. | 42/119 |
| 8,833,655 | B2 * | 9/2014 | McCarty et al. | 235/404 |
| 2005/0213962 | A1 * | 9/2005 | Gordon | F41A 33/00 396/502 |
| 2005/0252062 | A1 * | 11/2005 | Scrogin et al. | 42/119 |

(Continued)

*Primary Examiner* — Bret Hayes
*Assistant Examiner* — Derrick Morgan
(74) *Attorney, Agent, or Firm* — Prakash Nama; Daniel J. Long

(57) ABSTRACT

A system and method of aligning an accessory's aim point to an aim point of a device are disclosed. In one embodiment, an aim point that can be viewed through a weapon sight is projected from a device mounted on a weapon. Further, an accessory aim point is projected on the weapon sight by an accessory device that is mounted on the weapon in front of the weapon sight. Furthermore, the accessory aim point is pre-mission aligned to the aim point of the device by electronically adjusting a position of the accessory aim point to align with the aim point of the device on the weapon sight.

12 Claims, 3 Drawing Sheets

(56) References Cited

U.S. PATENT DOCUMENTS

2005/0268521 A1* 12/2005 Cox et al. ..... 42/130
2006/0010761 A1* 1/2006 Staley, III ..... 42/142
2007/0124982 A1* 6/2007 Cheng ..... F41G 1/345 42/113
2007/0277421 A1* 12/2007 Perkins et al. ..... 42/122
2008/0003543 A1* 1/2008 Varshneya ..... 434/21
2008/0309916 A1* 12/2008 Mok ..... 356/5.01
2009/0283598 A1* 11/2009 Sherman ..... 235/404
2009/0296210 A1* 12/2009 Schlierbach et al. ..... 359/428
2011/0114725 A1* 5/2011 Young ..... 235/407
2011/0297744 A1* 12/2011 Schneider et al. ..... 235/414
2012/0126001 A1* 5/2012 Justice et al. ..... 235/404
2012/0140201 A1* 6/2012 Grauslys et al. ..... 356/4.01
2012/0167439 A1* 7/2012 Jock et al. ..... 42/113
2012/0171643 A1* 7/2012 Reardon et al. ..... 434/11
2012/0180366 A1* 7/2012 Jaroh et al. ..... 42/114
2015/0059225 A1* 3/2015 Huang ..... F41G 1/30 42/113

* cited by examiner

SYSTEM AND METHOD OF ALIGNING AN ACCESSORY AIMPOINT TO AN AIMPOINT OF A DEVICE

CROSS-REFERENCE TO RELATED APPLICATIONS

This Application claims rights under 35 USC §119(e) from U.S. Application 61/909,787 filed Nov. 27, 2013, the contents of which are incorporated herein by reference.

BACKGROUND OF THE INVENTION

1. Field of the Invention

The present invention relates to devices mounted on weapons and more particularly to aligning an aim point of an accessory device to an aim point of a device.

2. Brief Description of Related Art

Typically, a device, such as a laser range finder (LRF), an infrared (IR) marker and the like mounted on a weapon is manually aligned to a weapon's aim point. Exemplary weapon aim points include an aim point of an advanced combat optical gunsight (ACOG) and other such sights. Existing techniques use windage and elevation adjusters to manually align the device to the weapon's aim point. However, some devices may be bulky and heavy and may require large windage and elevation adjusters. These adjusters consume weight and retaining boresight of the device with the weapon may be difficult during operation. Also, during mission, lasers or pointers emitted from the device are projected on a target which may disclose location of an operator of the device to the target.

SUMMARY OF THE INVENTION

A system and method of aligning an aim point of an accessory device to an aim point of a device are disclosed. According to one aspect of the present subject matter, the aim point of the device that can be viewed through a weapon sight is projected from the device (e.g., laser range finder (LRF) and infrared (IR) marker) mounted on a weapon. Further, the accessory's aim point is projected on the weapon sight by the accessory device that is mounted on the weapon in front of the weapon sight. Furthermore, the accessory's aim point is pre-mission aligned to the aim point of the device by electronically adjusting a position of the accessory's aim point to align with the aim point of the device on the weapon sight. In addition, the device is turned off upon aligning the accessory's aim point to the aim point of the device. During operation/mission, the accessory's aim point on the weapon sight is used instead of projecting an aim point from the device.

According to another aspect, of the present subject matter, a system includes a weapon. Further, a weapon sight and a device are mounted on the weapon. Furthermore, an accessory device is mounted on the weapon in front of the weapon sight. In addition, an electronic control unit is provided on the accessory device. In one embodiment, the device projects an aim point that can be viewed through the weapon sight. Further, the accessory device projects an accessory aim point on the weapon sight. Furthermore, the electronic control unit pre-mission aligns the accessory's aim point to the aim point of the device by electronically adjusting a position of the accessory's aim point to align with the aim point of the device on the weapon sight.

According to yet another aspect of the present subject matter, a weapon includes a weapon sight, a device, an accessory device disposed in front of the weapon sight and an electronic controls provided on the accessory device. In one embodiment, the device projects an aim point that can be viewed through the weapon sight. Further, the accessory device projects an accessory aim point on the weapon sight. In addition, the electronic control unit pre-mission aligns the accessory's aim point to the aim point of the device by electronically adjusting a position of the accessory's aim point to align with the aim point of the device on the weapon sight.

BRIEF DESCRIPITION OF THE DRAWINGS

The advantages and features of the present disclosure will become better understood with reference to the following detailed description and claims taken in conjunction with the accompanying drawings, wherein like elements are identified with like symbols, and in which;

DETAILED DESCRIPTION OF THE INVENTION

The exemplary embodiments described herein in detail for illustrative purposes are subject to many variations in structure and design.

A device, such as a laser range finder (LRF), an infrared (IR) marker and the like mounted on a weapon requires alignment to a weapon's aim point (e.g., aim point of a weapon sight). For alignment, some systems/methods implement adjusters for manually aligning the device. These adjusters may consume significant weight. Further, the functionality of the device may not require alignment to the weapon aim point.

The example technique disclosed herein aligns an aim point of an accessory device to an aim point of the device. In an example embodiment, when the device is turned on, the device projects an aim point on a target that can be viewed through the weapon sight. Further, the accessory device mounted on the weapon in front of the weapon sight couples the accessory's aim point in the weapon sight. Furthermore, the position of the accessory's aim point is electronically adjusted to align with the aim point of the device using digital windage and elevation adjustments. The accessory device is now calibrated to where the device is pointing and the device can be turned off during a mission. Further, providing the accessory's aim point in the weapon sight removes the need to co-boresight the device and the weapon. The minor angular offset between the weapon and the device is nulled electronically and not mechanically by the presence of the accessory's aim point.

Figure 1:
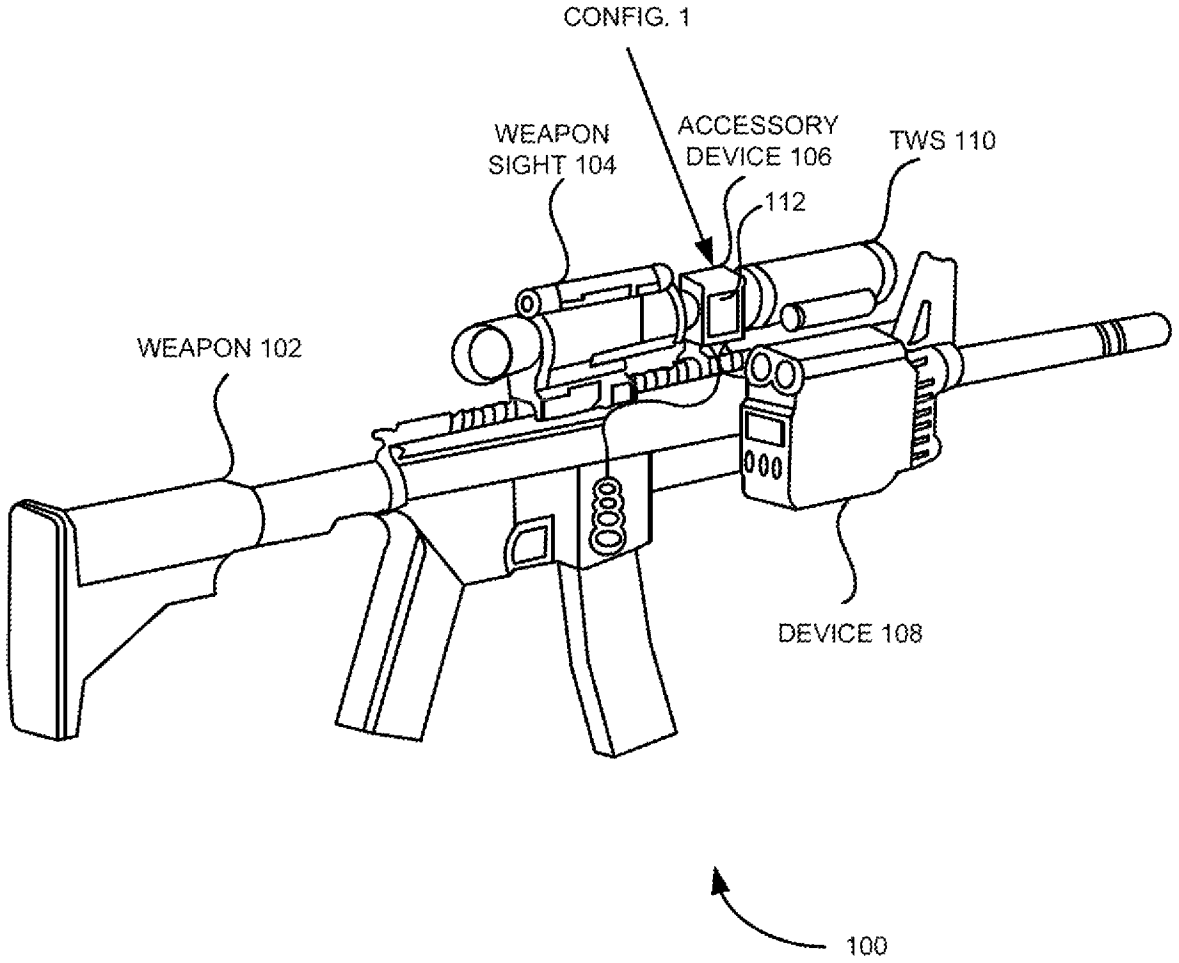
FIG. 1 illustrates an exemplary system for aligning an aim point of an accessory device to an aim point of a device, according to an embodiment.

Referring now to FIG. 1, which illustrates an exemplary system 100 for aligning an aim point of an accessory device 106 to an aim point of a device 108, according to an embodiment. As shown in FIG. 1, the system 100 includes at weapon 102. Further as shown in FIG. 1, a weapon sight 104 and the device 108 are mounted on the weapon 102. Exemplary weapon sight 104 includes an advanced combat optical gunsight (ACOG) and other such sights. Exemplary device 108 includes a LRF, an IR marker and any other device that is configured to emit light on a target. In the example illustrated in FIG. 1, a thermal weapon sight (TWS) 110 is mounted on the weapon 102.

Further as shown in FIG. 1, the accessory device 106 is mounted on the weapon 102 in front of the weapon sight 104. For example, the weapon sight 104, the accessory device 106 and the device 108 are mechanically mounted on the weapon 102 using a standard mounting platform, such as a picatinny rail and the like. The accessory device refers to a device that is configured to provide an accessory's aim point on a display of the weapon sight 104. In one example, the accessory device 106 includes a prism. Furthermore as shown in FIG. 1, an electronic control unit 112 is provided on the accessory device 106. In one embodiment, the electronic control unit 112 includes windage and elevation adjusters. For example, the windage and elevation adjusters are provided in the form of manual control buttons or virtual buttons on a touch screen.

During pre-mission alignment of the aim point of the accessory device 106 with the aim point of a device 108, the device 108 is turned on to project the aim point of the device 108 that can be viewed through the weapon sight 104. For example, the device 108 emits a laser light on a target object. Exemplary laser light includes visible light, infrared light, near-infrared light and the like. In this case, the laser light illuminates a spot on the target object. This spot is referred to as the aim point of the device. The aim point of the device 108 can be viewed by an operator through the weapon sight 104, as shown in FIG. 2B.

Further, the accessory device 106 projects the accessory's aim point on the weapon sight 104. In one example, when the accessory device 106 is turned on, a collimated light source in the accessory device 106 emits light on the prism. Further, the light is projected onto the weapon sight 104 via a prism. The light projected on the weapon sight 104 indicates the accessory's aim point.

Furthermore during the pre-mission alignment, the electronic control unit 112 aligns the accessory's aim point to the aim point of the device 108 by electronically adjusting a position of the accessory's aim point to align with the aim point of the device 108 on the weapon sight 104. In one embodiment, the operator electronically adjusts the position of the accessory's aim point, using the windage and elevation adjusters, to align with the aim point of the device 108 using windage and elevation adjustments of the accessory's aim point. Upon aligning the accessory's aim point with the aim point of the device 108, the device 108 can be turned off. For example, during a mission, the device 108 may be turned off to conceal location of the operator.

In one example embodiment, a status of the device 108 is displayed on the weapon sight 104. For example status of the device 108 includes built in test (BIT), battery life, mode operation, firing indicator, and the like. Further, during a mission, without the use of laser light from the device 108, the target can be engaged with the device 108 by using the accessory's aim point projected into the weapon sight 104.

Referring now to FIGS. 2A to 2D, which are schematic illustrations of the method of aligning the aim point of the accessory device 106 to the aim point of the device 108, according to an embodiment. Particularly. FIGS. 2A to 2D illustrate exemplary reticle as viewed by the operator through the weapon sight 104, shown in FIG. 1.

Figure 2A:
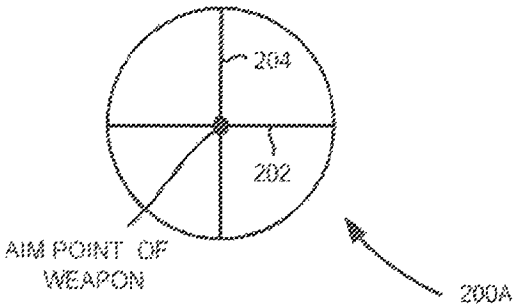
FIGS. 2A to 2D are schematic illustrations of the method of aligning the aim point of the accessory device to the aim point of the device, according to an embodiment.
Figure 2B:
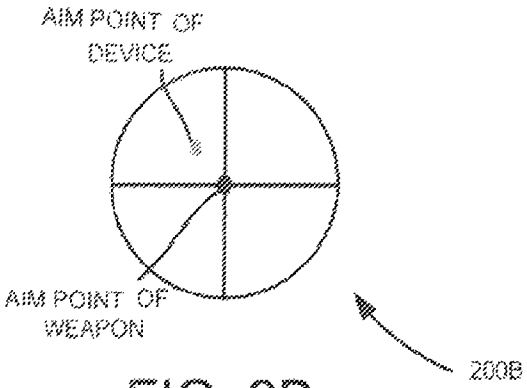

Now, referring to FIG. 2A, reticle 200A illustrates an aim point of the weapon 102, i.e., an aim point of the weapon sight 104. Particularly, reticle 200A illustrates the aim point of the weapon 102 viewed by the operator through the weapon sight 104 when the accessory device 106 is turned off. The aim point of the weapon is defined by the intersection of a horizontal sight line 202 and a vertical sight line 204 in the weapon sight 104.

Now, referring to FIG. 2B, reticle 200B illustrates the aim point of the device 108 viewed by the operator through the weapon sight 104. The aim point of the device 108 is projected by the device 108, shown in FIG. 1. This is explained in detail with reference to FIG. 1.

Figure 2C:
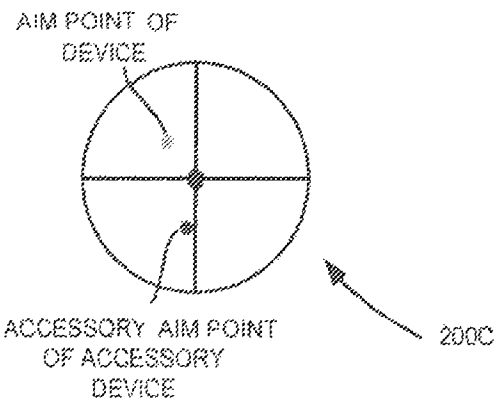

Now, referring to FIG. 2C, reticle 200C illustrates the aim point of the accessory device 106 along with the aim point of the device 108. The accessory's aim point is projected on the weapon sight 104 by the accessory device 106, shown in FIG. 1. This is explained in detail with reference to FIG. 1.

Figure 2D:
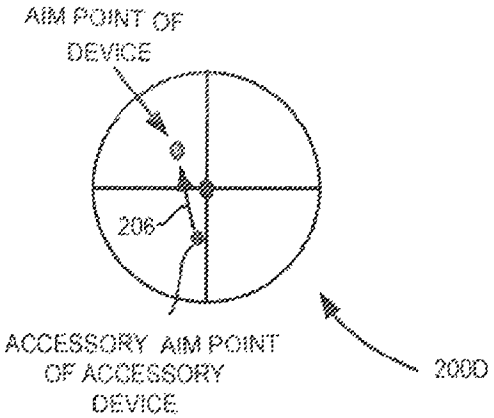

Now, referring to FIG. 2D, a position of the accessory's aim point is electronically adjusted, in a direction indicated by 206, to align with the aim point of the device 108 on the weapon sight 104. In one embodiment, the position of the accessory's aim point is electronically adjusted using windage and elevation adjustment of the accessory's aim point. This is explained in detail with reference to FIG. 1. Upon aligning the accessory device 106 to where the device 108 is pointing, the device 108 may be turned of during a mission.

Figure 3:
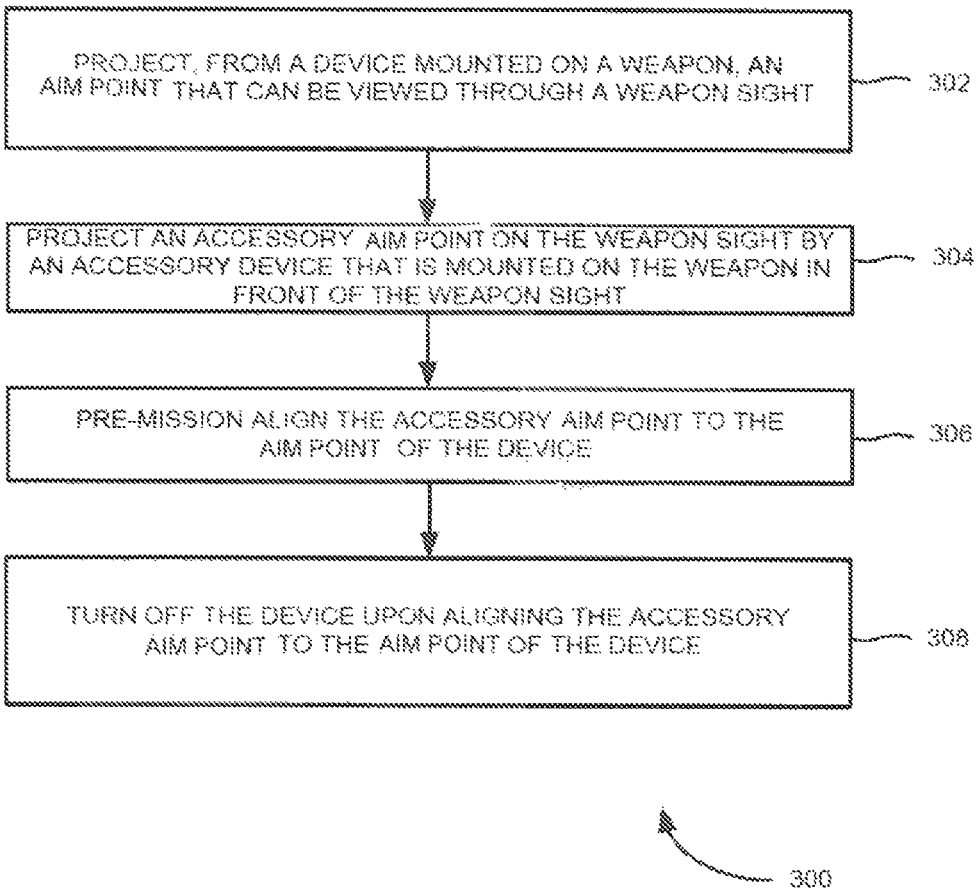
FIG. 3 is a flowchart illustrating an exemplary method for aligning the aim point of the accessory device to the aim point of the device, according to an embodiment.

Referring now to FIG. 3, which is a flowchart 300 illustrating an exemplary method for aligning an accessory's aim point to an aim point of a device, according to an embodiment. At block 302, an aim point that can be viewed through a weapon sight is projected from a device mounted on a weapon. Exemplary weapon sight includes an advanced combat optical gunsight (ACOG) and the like. Exemplary device includes of a LRF, an IR marker and the like. In one example, the device emits laser light on a target object. Exemplary laser light includes a visible light, infrared light, near infrared light and the like.

At block 304, an accessory's aim point is projected on the weapon sight by an accessory device that is mounted on the weapon in front of the weapon sight. At block 306, the accessory's aim point is pre-mission aligned to the aim point of the device by electronically adjusting a position of the accessory's aim point to align with the aim point of the device on the weapon sight. In one embodiment, the position of the accessory's aim point is electronically adjusted to align with the aim point of the device using windage and elevation adjustment of the accessory's aim point. At block 308, the device is turned off upon aligning the accessory's aim point to the aim point of the device.

In various embodiments, the systems and methods described in FIGS. 1 through 3 propose a technique for pre-mission aligning an accessory's aim point to an aim point of a device. The proposed technique uses standard mounting platforms for mounting the accessory device on the weapon. Further, the accessory device can be used with any clip on thermal devices mounted on the weapon.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure.

What is claimed is:

1. A method of pre-mission aligning an accessory aim point to an aim point of a first device, comprising:

projecting, from the first device mounted on a weapon, the aim point that can be viewed through a weapon sight, wherein the first device comprises one of a laser range finder (LRF) and an infrared (IR) marker:

projecting the accessory aim point on the weapon sight by an accessory device that is mounted on the weapon in front of the weapon sight, wherein the accessory aim point is a light projected by a collimated light source in the accessory device onto the weapon sight via a prism; and pre-mission aligning of the accessory aim point of the accessory device to the aim point of the first device by electronically adjusting a position of the accessory aim point of the accessory device to align with the aim point of the first device on the weapon sight, wherein offset between the weapon and the first device is nulled electronically using the accessory aim point.

2. The method of claim 1, wherein the position of the accessory aim point is electronically adjusted to align with the aim point of the first device using windage and elevation adjustment of the accessory aim point.

3. The method of claim 1, wherein the weapon sight comprises an advanced combat optical gunsight (ACOG).

4. The method of claim 1, wherein the first device emits laser light comprising one of a visible light, infrared light or near infrared light on a target object.

5. The method of claim 1, further comprising:

turning off the first device upon aligning the accessory aim point to the aim point of the first device.

6. A system, comprising:

a weapon;

a weapon sight mounted on the weapon;

a first device mounted on the weapon, the first device projects an aim point that can be viewed through the weapon sight, wherein the first device comprises one of a laser range finder (LRF) and an infrared (IR) marker;

an accessory device mounted on the weapon in front of the weapon sight, the accessory device projects an accessory aim point on the weapon sight, wherein the accessory device comprises a collimated light source, wherein the accessory aim point is a light projected by the collimated light source onto the weapon sight via a prism; and an electronic control unit provided on the accessory device to pre-mission align the accessory aim point of the accessory device to the aim point of the first device by electronically adjusting a position of the accessory aim point of the accessory device to align with the aim point of the first device on the weapon sight, wherein offset between the weapon and the first device is nulled electronically using the accessory aim point.

7. The system of claim 6, wherein the electronic control unit comprises windage and elevation adjusters for electronically adjusting the position of the accessory aim point to align with the aim point of the first device using windage and elevation adjustment of the accessory aim point.

8. The system of claim 6, wherein the weapon sight comprises an advanced combat optical gunsight (ACOG).

9. The system of claim 6, wherein the first device emits laser light comprising one of a visible light, infrared light or near infrared light on a target object.

10. The system of claim 6, wherein the first device is turned off upon aligning the accessory aim point with the aim point of the first device.

11. A weapon, comprising:

a weapon sight;

a first device to project an aim point that can be viewed through the weapon sight, wherein the first device comprises one of a laser range finder (LRF) and an infrared (IR) marker;

an accessory device disposed in front of the weapon sight, the accessory device projects an accessory aim point on the weapon sight, wherein the accessory aim point is a light projected by a collimated light source in the accessory device onto the weapon sight via a prism; and an electronic control unit provided on the accessory device to pre-mission align the accessory aim point of the accessory device to the aim point of the first device by electronically adjusting a position of the accessory aim point of the accessory device to align with the aim point of the first device on the weapon sight, wherein offset between the weapon and the first device is nulled electronically using the accessory aim point.

12. The weapon of claim 11, wherein the weapon sight comprises an advanced combat optical gunsight (ACOG).

* * * * *